United States Patent [19]

Savonjousi

[11] Patent Number: 5,011,090

[45] Date of Patent: Apr. 30, 1991

[54] METHOD FOR CONTROLLING A CHIP REFINER

[75] Inventor: Aslak Savonjousi, Espoo, Finland

[73] Assignee: ABB Stromberg Teollisuus Oy, Helsinki, Finland

[21] Appl. No.: 460,368

[22] Filed: Jan. 3, 1990

[51] Int. Cl.[5] ..... B02C 25/00

[52] U.S. Cl. ..... 241/21; 241/28; 241/34; 241/247

[58] Field of Search ..... 241/30, 34, 35, 246, 241/247, 28, 21

[56] References Cited

U.S. PATENT DOCUMENTS 3,960,330 6/1976 Henson ..... 241/34 X
4,943,347 7/1990 Floden ..... 241/34 X

FOREIGN PATENT DOCUMENTS 575129 10/1977 U.S.S.R. ..... 241/34
621377 8/1978 U.S.S.R. ..... 241/34
641998 1/1979 U.S.S.R. ..... 241/34

*Primary Examiner*—Mark Rosenbaum

[57] ABSTRACT

A method for controlling a chip refiner meters chips into the chip refiner with the help of a metering device and feeder which is adapted to the chip refiner for feeding chips between refiner disks. Water is added to the chips prior to feeding them between the refiner disks. Input power to the feeder means is measured, and using conventional methods, the volume of chip stock metered to the feeder is controlled with the help of the metering device so as to regulate the input power to the feeder to constant level.

5 Claims, 2 Drawing Sheets

METHOD FOR CONTROLLING A CHIP REFINER

FIELD OF THE INVENTION

The present invention relates to a method for controlling a chip refiner.

DESCRIPTION OF THE BACKGROUND ART

In prior-art implementations, chip stock has been fed into the chip refiner at a constant rate. Because of the variations in the chip stock consistency and chip size, this method is incapable of producing refined stock at a constant quality.

Also, controlled systems are known in the art in which chip stock is fed using a variable-speed motor. In one of these methods, feed rate is controlled by regulating the input power to the chip refiner from the power source to a constant level. Even if a constant load by the refiner on the power source is maintained, uneven quality of the refined stock will result, due to variations in chip stock consistency and moisture content. In another method using control means, chip stock is fed into the chip refiner at controllable set rate by measuring the output rate and refined stock consistency from the chip refiner, computing the product of these measurement variables which is relative to mass flow rate, and the obtained mass flow rate is used as the input variable for the control loop of the input feed rate. Because of the technical difficulties in deriving the value of the mass flow rate, the control response of the method is rather slow. Consequently, an unsatisfactory quality of refined stock results therefrom.

SUMMARY OF THE INVENTION

The aim of the present invention is to overcome the disadvantages of prior-art methods described above and to achieve a novel method for the control of a chip refiner.

The invention is based on measuring the drive power level of the auger feeding the chip refiner and controlling this power to a constant level by regulating the chip stock feed rate to the chip refiner.

More specifically, the system in accordance with the invention is characterized by a chip refiner having a chip stock metered by chip stock metering means, chip feeder means and water being added to the chips prior to feeding them between the refiner disks of a refiner. Power input to the feeder means is measured and the quantity of chip stock to be metered to the feeder means is controlled.

The invention provides outstanding benefits.

By way of measuring the input power to the drive motor of the feeder auger in order to obtain a measurement value for the density of the chip stock to be refined, a control method for the regulation of chip stock consistency in the refiner gap to a constant value is achieved that is superior to those used in prior-art methods, because the control variable is immediately available.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is next examined in detail with the help of an exemplifying embodiment illustrated in the attached drawings which are given by way of illustration only, and thus are not limitative of the present invention, and wherein.

DETAILED DESCRIPTION OF THE PREFERRED EMBODIMENTS

Figure 1:
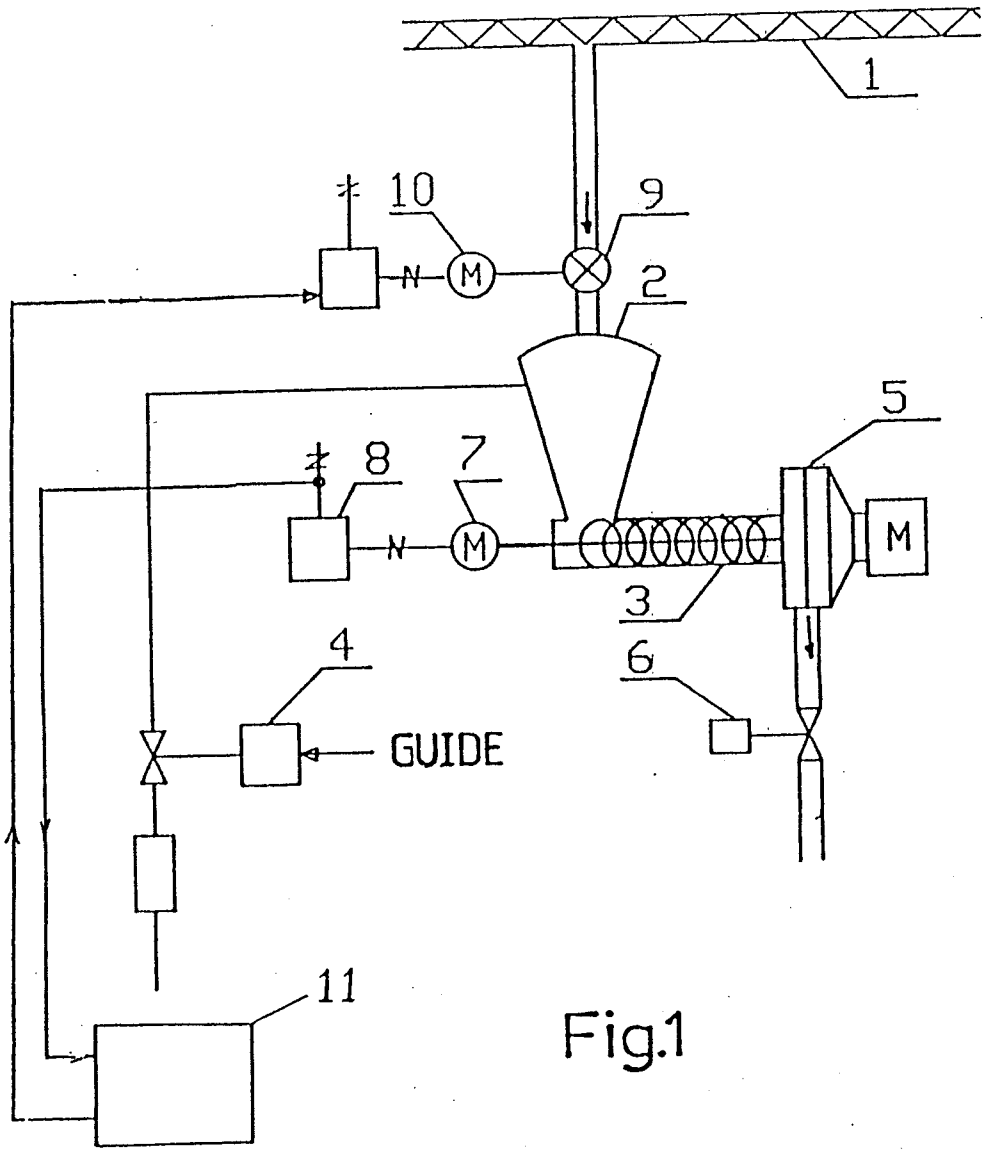
FIG. 1 shows in a diagrammatic form a control system in accordance with the present invention.

According to FIG. 1, the chip stock to be refined is brought to the refining plant with the held of a Conveyor 1. The chips are fed and metered by means of a metering feeder 9 driven by a metering motor 10 into a feeder bin 2 of the refiner, from where they are further fed by means of a feeder auger 3 driven by a feeder motor 7 into the gap between the refiner disks S. Either in the feeder bin 2, in the feeder auger 3 or between the gap of the disks 5, water is added to the chips by a volume controlled by a controller 4. Between the disks 5 the chips are ground into refined stock and the developed steam propels the refined stock forward via a control valve 6 of the refined stock flow. The purpose of the control valve 6 is to maintain a constant steam pressure level in the refiner. In addition to internal losses, the feeder motor 7 is loaded by forces imposed by the chips on the feeder auger 3. Because density variations in fed chip stock tend to cause changes in produced refined stock quality, the input power to the feeder motor 7 is measured in a conventional manner by means of measurement equipment 8, which is connected to the power input of the feeder motor 7 and whose measurement signal is entered to a control unit 11 of the metering motor 10. The control unit 11 controls the speed of the metering motor 10 so that a decrease in the input power of the feeder motor 7 produces an increase in the speed of the metering motor 10, and vice versa.

The following example clarifies a typical case of control performance.

Prior to a disturbance in chip stock consistency, the signal level of motor current, which is proportional to the input power, was measured with the measurement equipment 8 to be 2.6 A. At the onset of a density disturbance, the input power representing signal had attained a level of 2.3 A. With the help of control measures performed in the conventional manner by the controller 11, the feed rate of the feeder means was elevated so much that the input power representing signal attained a value of 2.57 A. In the prevailing test conditions, this corrective action can be considered to have an acceptable accuracy. The freeness of the produced refined stock was measured from a few samples prior to the onset of the disturbance to be 342 . . . 3S0 CSF. At the onset of the disturbance, a drop to 320 CSF in freeness was detected, which through the control measures was quickly corrected to a level of 338...348 CSF as measured again from a few samples. The referred values prove the validity of the method in function. Using a better timed system, even more accurate results are possible.

Figure 2:
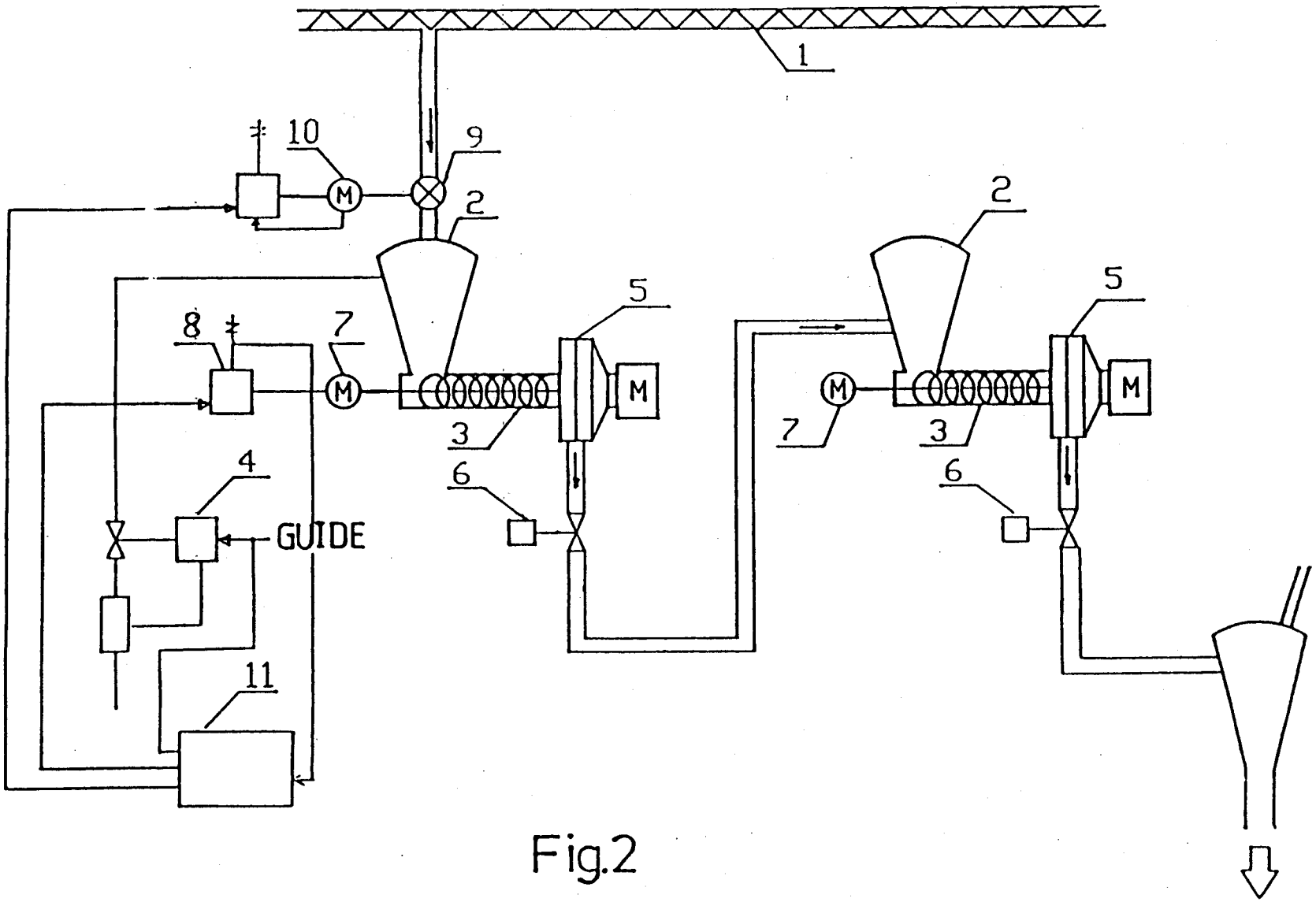
FIG. 2 shows in a diagrammatic form another control system in accordance with the present invention.

As shown in FIG. 2, two or more refiners can be connected in tandem.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for controlling feed rate of a chip refiner comprising the steps of:

metering chip stock from a chip stock meter to a refiner for refining:

feeding metered chips by a chip feeder to refiner disks;

adding water to the chips prior to feeding the chips between the refiner disks;

measuring power input to the chip feeder; and controlling a quantity of chip stock metered to the chip feeder in response to measured input power to the chip feeder whereby input power to the chip feeder is regulated to a generally constant level.

2. The method as recited in claim 1, further comprising the step of increasing metered chip stock volume from the chip stock meter when input power to the chip feeder decreases.

3. The method as recited in claim 1, wherein the step of measuring power input to the chip feeder is continuous to thereby continuously control metering of chip stock.

4. The method as recited in claim 1, wherein the step of measuring power input to the chip feeder is repetitive at short intervals to control the metering of chip stock in a short-term cycle.

5. The method as recited in claim 1, further comprising the steps of:

maintaining a generally constant pressure level of steam in the refiner by using a control valve; and propelling refined stock forward from the refiner disks by the steam.

* * * * *